US008770875B2

(12) United States Patent
Sugahara

(10) Patent No.: US 8,770,875 B2
(45) Date of Patent: Jul. 8, 2014

(54) RECORDING APPARATUS

(71) Applicant: Brother Kogyo Kabushiki Kaisha, Aichi-Ken (JP)

(72) Inventor: Hiroto Sugahara, Ama (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 5 days.

(21) Appl. No.: 13/758,288

(22) Filed: Feb. 4, 2013

(65) Prior Publication Data

US 2013/0257947 A1 Oct. 3, 2013

(30) Foreign Application Priority Data

Mar. 30, 2012 (JP) ..... 2012-082162

(51) Int. Cl.
*B41J 11/08* (2006.01)
*B41J 11/00* (2006.01)
*B41J 2/045* (2006.01)

(52) U.S. Cl.
CPC ..... *B41J 11/007* (2013.01); *B41J 11/008* (2013.01); *B41J 2/04526* (2013.01)
USPC ..... 400/578; 347/104

(58) Field of Classification Search
USPC ..... 347/104, 105
See application file for complete search history.

(56) References Cited

U.S. PATENT DOCUMENTS

| | | | | |
|---|---|---|---|---|
| 4,417,517 | A * | 11/1983 | Matsuda et al. | 101/288 |
| 2002/0089564 | A1* | 7/2002 | Ohashi | 347/41 |
| 2004/0189767 | A1* | 9/2004 | Kodama et al. | 347/101 |
| 2011/0205298 | A1 | 8/2011 | Tamada et al. | |

FOREIGN PATENT DOCUMENTS

| | | |
|---|---|---|
| JP | 6135058 | 5/1994 |
| JP | 2010069664 | 4/2010 |
| JP | 2011/173374 | 9/2011 |

* cited by examiner

*Primary Examiner* — Stephen Meier
*Assistant Examiner* — Renee I Wilson
(74) *Attorney, Agent, or Firm* — Frommer Lawrence & Haug LLP

(57) ABSTRACT

There is provided a recording apparatus including: a recording head having recording elements arranged in a first direction; a first transporting mechanism having a first supply roller and a first discharge roller to transport the first recording medium; a second transporting mechanism arranged between the first supply and discharge rollers in the first direction to transport the second recording medium, the second transporting mechanism holding an overlap portion, of the second recording medium, overlapping in the first direction with a portion of a recording range in which the recording elements of the recording head are arranged; and a controller controlling the recording head to perform recording on the second recording medium by using only a part of the recording elements which are located to overlap with the overlap area of the second recording medium.

16 Claims, 14 Drawing Sheets

RECORDING APPARATUS

CROSS REFERENCE TO RELATED APPLICATION

The present application claims priority from Japanese Patent Application No. 2012-082162 filed on Mar. 30, 2012 the disclosure of which is incorporated herein by reference in its entirety.

BACKGROUND OF THE INVENTION

1. Field of the Invention

The present invention relates to a recording apparatus which records text (letter), image, etc. on a recording medium.

2. Description of the Related Art

There is known an ink-jet printer which records image, etc. on a recording paper as a recording medium. Such an ink-jet printer is provided with an ink-jet head which discharges an ink toward the recording paper, and a transporting mechanism which transports the recording paper to the ink-jet head.

The inkjet head discharges the ink toward the recording paper while moving along a predetermined scanning direction with respect to the recording paper. The transporting mechanism has two rollers which are arranged to sandwich the ink-jet head therebetween in a transporting direction orthogonal to the scanning direction, and transports the recording paper supplied by a paper supplying mechanism in the transporting direction with the two rollers.

SUMMARY OF THE INVENTION

Some users demand that a recording apparatus such as the above-described ink jet printer is equipped with a function for recording text, image, etc. on two or more types of recording media of which size are greatly different. For example, such a demand is exemplified by a function of performing recording not only on a plurality of recording paper of which sizes are A4, A3, etc., but also on a recording medium such as a paper tape of which length and width are considerably small. However, the ink-jet printer, as described above, which transports a recording medium (recording paper) of which size is considerably great is not capable of performing recording on a recording medium such as a repositionable note (tag-label, slip-note or paper-tape), etc. of a short length because the distance between the two rollers is great. Further, in a case of transporting an elongated and narrow-width recording medium such as a paper tape, even if it is possible to perform the transportation of such a recording medium per se, the recording medium is easily twisted between the two rollers due to the narrow width, which would in turn make the posture of the recording medium be unstable.

An object of the present teaching is to provide a recording apparatus capable of transporting even a small-sized recording medium while maintaining the posture of the small-sized recording medium during the transportation.

According to an object of the present teaching, there is provided a recording apparatus configured to perform recording on a first recording medium and on a second recording medium, the recording apparatus including:

a recording head having a plurality of recording elements arranged in a first direction;

a first transporting mechanism having a first supply roller and a first discharge roller which are arranged to sandwich the recording head therebetween in the first direction, and configured to transport the first recording medium with respect to the recording head in the first direction by the first supply roller and the first discharge roller; and a second transporting mechanism arranged between the first supply roller and the first discharge roller in the first direction, configured to transport the second recording medium in the first direction while maintaining posture of the second recording medium, and configured to hold an overlap portion, of the second recording medium, overlapping in the first direction with a portion of a recording range in which the plurality of recording elements of the recording head are arranged; and a controller configured to control the recording head to perform recording on the second recording medium, which is transported by the second transporting mechanism, by using only a part of the recording elements arranged in the first direction, the part of the recording elements being located to overlap with the overlap area, of the second recording medium, held by the second transporting mechanism.

In the present teaching, the second transporting mechanism may include a second supply roller and a second discharge roller which are arranged with a spacing distance therebetween in the first direction;

the second transporting mechanism may be configured to transport the second recording medium by the second supply roller and the second discharge roller with respect to the recording head in the first direction;

the spacing distance between the second supply roller and the second discharge roller in the first direction may be smaller than a spacing distance between the first supply roller and the first discharge roller in the first direction. In this case, the spacing distance between the second supply roller and the second discharge roller which are configured to transport the second recording medium is smaller than the spacing distance between the first supply roller and the first discharge roller which are configured to transport the first recording medium, thereby making it possible to stably transport the second recording medium of which size (length and/or width) is small. Further, by locating at least one of the second supply roller and the second discharge roller inside the recording range in the first direction, it is possible to further reduce the spacing distance between the second supply roller and the second discharge roller. Note that, however, recording elements, among the plurality of recording elements arranged in the recording range, which are not located between the second supply roller and the second discharge roller cannot be used for performing recording on the second recording medium. Accordingly, the recording head uses only a part of the recording elements located between the second supply roller and the second discharge roller to perform recording on the second recording medium.

BRIEF DESCRIPTION OF THE DRAWINGS

FIGS. 10A and 10B are view explaining a printer of a third modification, wherein FIG. 10A is a plane view of an ink-jet head; and FIG. 10B is a cross-sectional view of the printer, corresponding to FIG. 4.

DESCRIPTION OF THE PREFERRED EMBODIMENTS

Figure 1:
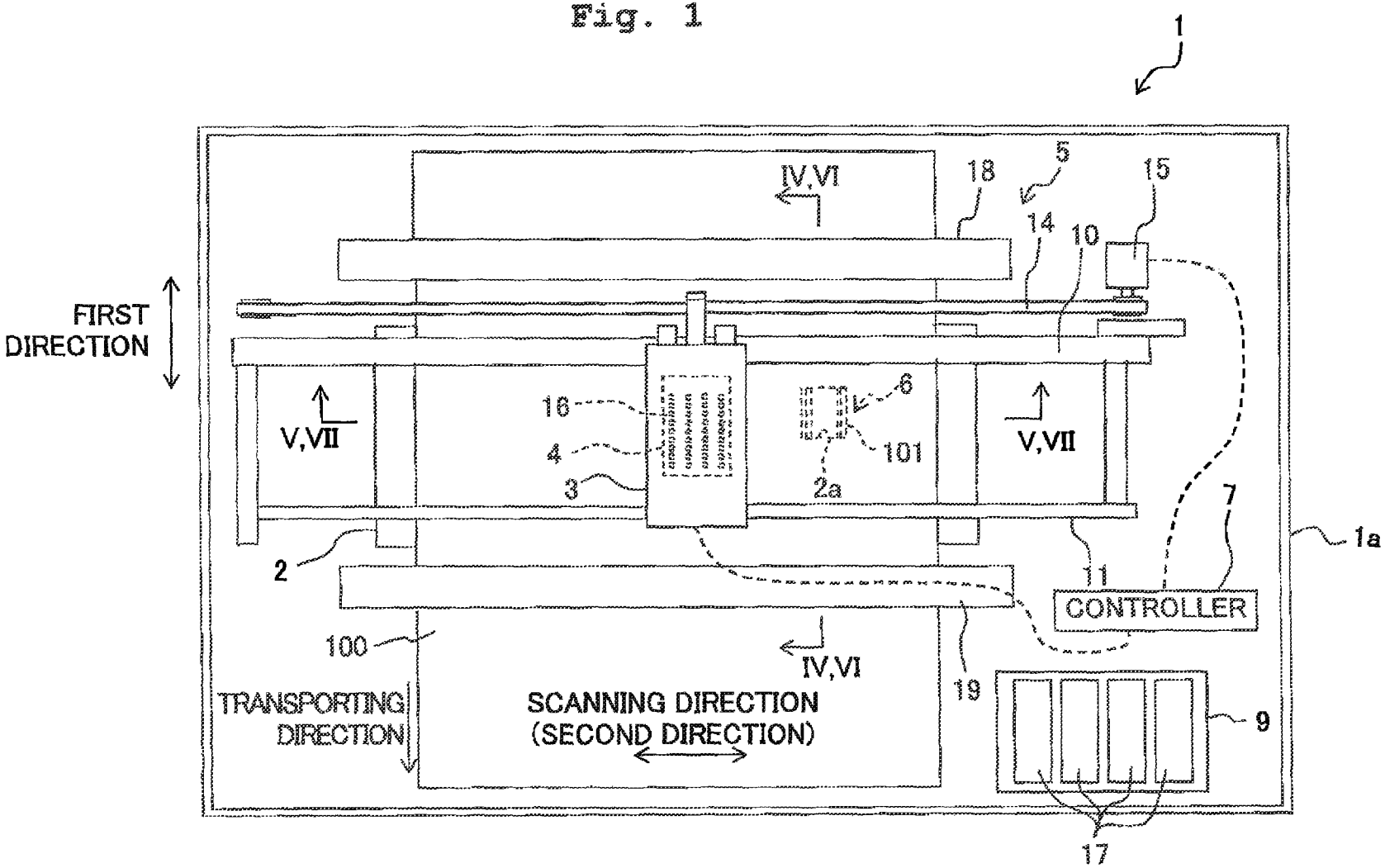
FIG. 1 is a schematic plane view of an ink-jet printer according to an embodiment of the present teaching.

Next, an embodiment of the present teaching will be explained with reference to the drawings. Note that in the following explanation, the upper side is defined as the foreground side of the sheet surface of FIG. 1 and the lower side is defined as the other side of the sheet surface of FIG. 1, using the terms indicating directions that are "upper" and "lower" as appropriate. Further, in the following explanation, the vertical direction in FIG. 1 is referred to as "first direction" and the direction orthogonal to the first direction in FIG. 1 is referred to as "second direction". One direction in the first direction (downward in FIG. 1) is the orientation or direction in which a recording paper 100 is transported, and is particularly referred to as "transporting direction". Further, the second direction is a direction in which an ink-jet head 4 is moved, and is occasionally referred also to as "scanning direction" in the following explanation.

The ink-jet printer of the embodiment is capable of recording an image, text, etc. on each of two types of recording media which are a recording paper 100 (first recording medium) having a rectangular shape and a size of A4, etc., and a band-shaped or a strip-shaped tape 1001 (second recording medium) having a width smaller than that of the recording paper 100. As shown in FIG. 1, the ink-jet printer 1 (recording apparatus) is provided with a platen 2, a carriage 3, an ink-jet head 4, a first transporting mechanism 5 which transports the recording paper 100, a second transporting mechanism 6 which transports the tape 101, and a controller 7. Note that the controller 7 is provided with various kinds of control circuits such as a CPU (Central Processing Unit), a ROM (Read Only Memory), a RAM (Random Access Memory), ASIC (Application Specific Integrated Circuit), etc. The controller 7 controls the ink-jet head 4, the first transporting mechanism 5, the second transporting mechanism 6, etc. in accordance with various kinds of programs stored in the memories such as the ROM and RAM, etc. For example, as will be described later on, in a case of performing recording on the second recording medium such as the tape 101, etc. transported by the second transporting mechanism 6, the controller 7 controls the ink-jet head 4, the second transporting mechanism 6, etc. such that the recording is performed on the second recording medium by using only a part of the nozzles.

The recording paper 100 is placed on the upper surface of the platen 2. Note that an opening 2*a* is formed in the platen 2 at a part of an area on which the recording paper 100 is placed, and the tape 101 and the second transporting mechanism 6 which transports the tape 101 (to be described later on, see FIGS. 4 to 7) are accommodated inside the opening 2*a*.

Two guide rails 10 and 11 are arranged at a position above or over the platen 2, and extend parallel to each other in the scanning direction (second direction). The carriage 3 is movable in the scanning direction along the two guide rails 10 and 11 in an area at which the carriage 3 faces or is opposite to the platen 2. An endless belt 14 is connected to the carriage 3. By driving the endless belt 14 to run by a driving motor 15, the carriage 3 is reciprocated in the scanning direction. Note that in FIG. 1, although the scanning direction as the moving direction of the carriage 3 is orthogonal to the transporting direction of the recording paper 100, the present teaching is not limited only to such a configuration. For example, it is also allowable that the carriage 3 and the first transporting mechanism 5 are configured such that the carriage 3 is moved in a direction crossing the transporting direction at an angle which is different from 90 degrees.

The ink-jet head 4 is installed in the carriage 3 in a posture that a surface of the ink-jet head 4 formed with a plurality of nozzles 16 (ink discharge surface) faces the platen 2 located below or under the ink-jet head 4. The ink-jet head 4 is connected, via a tube (not shown in the drawing), to a cartridge holder 9 disposed on a body 1*a* of the printer. Four ink cartridges 17 storing four color inks (black, yellow, cyan and magenta inks) respectively are installed in the cartridge holder 9.

Figure 2:
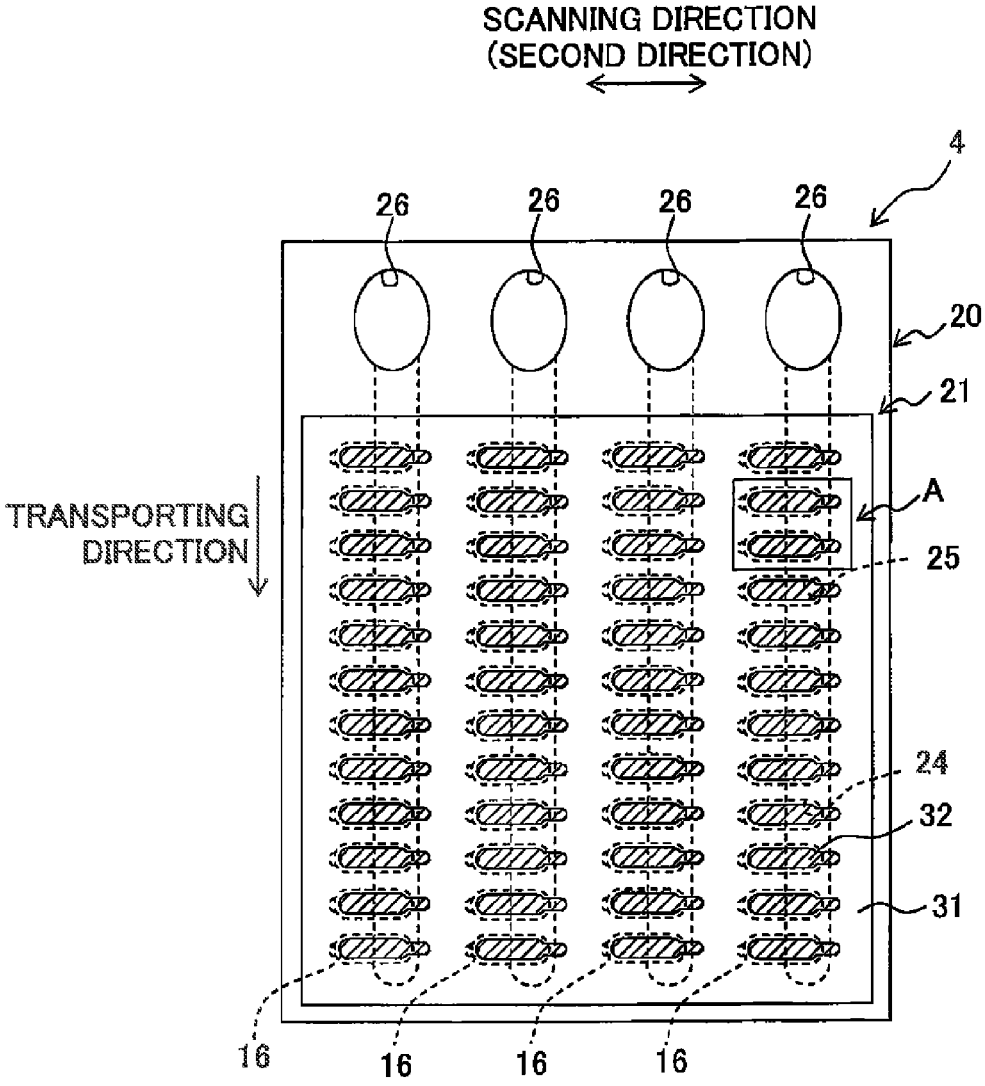
FIG. 2 is a plane view of an ink-jet head.
Figure 3A:
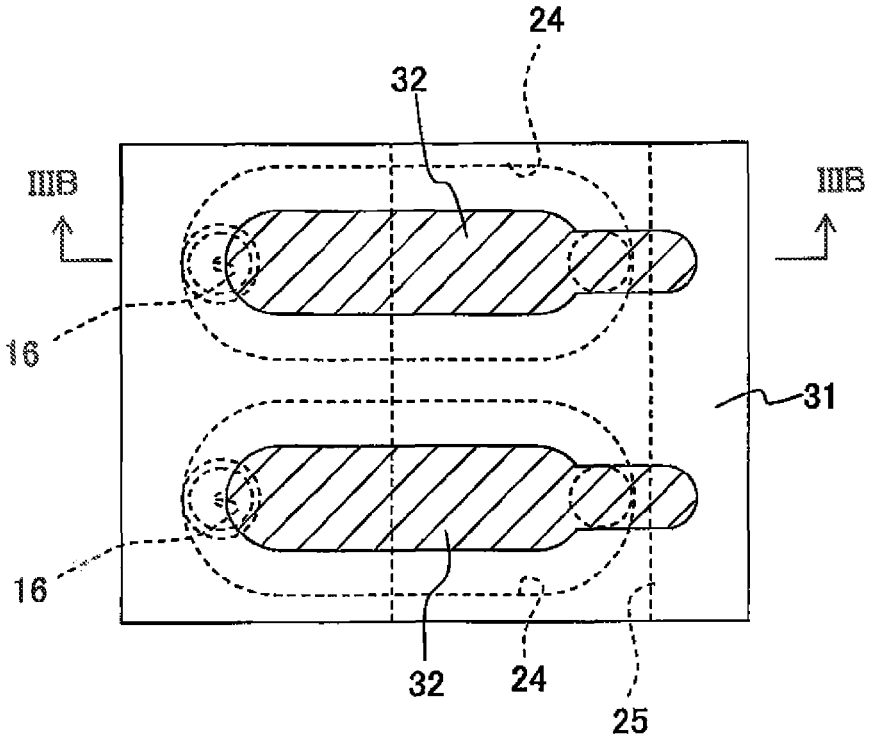
FIG. 3A is a partial enlarged view of FIG. 2.
Figure 3B:
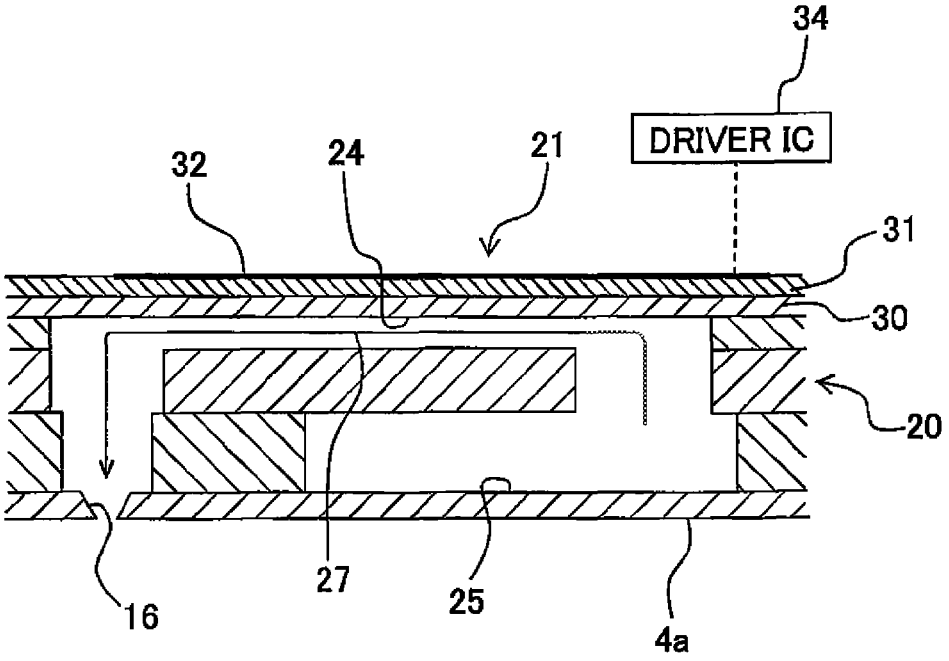
FIG. 3B is a cross-sectional view taken along a IIIA-IIIA line in FIG. 3A.

As shown in FIGS. 2, 3A and 3B, the ink-jet head 4 is provided with a channel unit 20 in which the plurality of nozzles 16 and a plurality of pressure chambers 24 communicating with the nozzles 16, respectively, are formed; and a piezoelectric actuator 21 which is arranged on the upper surface of the channel unit 20.

As shown in FIG. 3B, the channel unit 20 has a stacked structure in which four plates are stacked. The lower surface of the channel unit 20 is formed with the plurality of nozzles 16, defining an ink discharge surface 4*a*. As shown in FIG. 2, the nozzles 16 are arranged in the transporting direction orthogonal to the scanning direction so as to construct four nozzle rows corresponding to the four color inks (black, yellow, cyan and magenta inks), respectively.

Further, the plurality of pressure chambers 24 communicating with the nozzles 16, respectively, are formed in the channel unit 20. The pressure chambers 24 are arranged in four rows in a similar manner with the nozzles 16. Furthermore, the channel unit 20 is formed with four manifolds 25 (common ink chambers) via which the four color inks of black, yellow, cyan and magenta are supplied to the four rows of the pressure chambers, respectively. Note that end portions, on the upstream side in the transporting direction, of the four manifolds 25 are connected to four ink supply holes 26 (ink supplying sections), respectively, which are formed in the upper surface of the channel unit 20. The four ink supply holes 26 are connected to the four ink cartridges 17 of the cartridge holder 9 shown in FIG. 1.

As shown in FIG. 3B, the piezoelectric actuator 21 is provided with a vibration plate 30 covering the pressure chambers 24; a piezoelectric layer 31 which is arranged on the upper surface of the vibration plate 30; and a plurality of individual electrodes 32 which are arranged to correspond to the pressure chambers 24, respectively. The individual electrodes 32 located on the upper surface of the piezoelectric layer 31 are each connected to a driver IC which drives the piezoelectric actuator 21. Further, the vibration plate 30 arranged on the lower surface of the piezoelectric layer 31 is made of a metallic material, and serves as a common electrode facing the individual electrodes 32 with the piezoelectric layer 31 intervening therebetween. Note that the vibration plate 30 is connected to a ground wire of the drive IC 34 to be always maintained at the ground potential.

In this piezoelectric actuator 21, when a predetermined driving voltage is applied from the driver IC 34 between a certain individual electrode 32, among the plurality of individual electrodes 32, and the vibration plate 30 as the common electrode, piezoelectric deformation (piezoelectric strain) is generated at a portion (active portion), of the piezoelectric layer 31, sandwiched between the certain individual electrode 32 and the vibration plate 30. This piezoelectric deformation of the piezoelectric layer 31 causes the volume change in a pressure chamber 24, among the plurality of pressure chambers 24, corresponding to the certain individual electrode 32, thereby applying pressure to the ink inside the pressure chamber 24. At this time, a droplet of the ink is discharged from a nozzle 16, among the plurality of nozzles 16, communicating with the pressure chamber 24.

Figure 4:
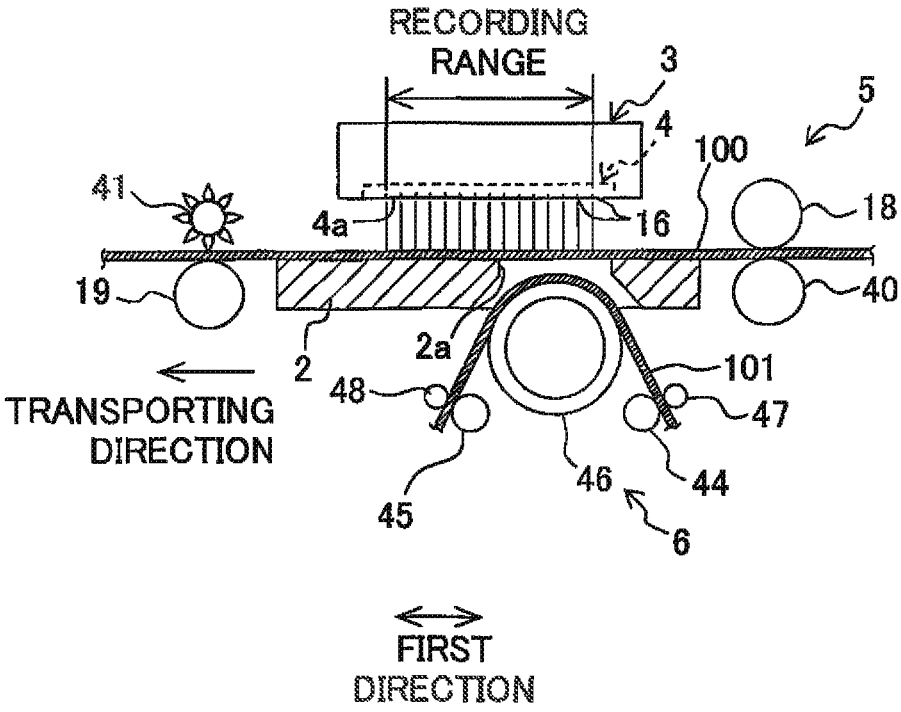
FIG. 4 is a cross-sectional view of the printer shown in FIG. 1 during recording on recording paper, taken along a IV-IV line (VI-VI line) in FIG. 1.

Next, the first transporting mechanism 5 will be explained with reference to the drawings. As shown in FIGS. 1 and 4, the first transporting mechanism 5 is provided with a first supply roller 18 and a first discharge roller 19 which are arranged so as to sandwich the ink-jet head 4 and the platen 2 therebetween in the first direction.

The first supply roller 18 and the first discharge roller 19 are driven by an un-illustrated driving motor. The first supply roller 18 is located, together with a pressing roller 40, at the upstream side of the ink-jet head 4 in the transporting direction, and the first supply roller 18 transports the recording paper 100, which is pinched between the first supply roller 18 and the pressing roller 40, toward the ink-jet head 4. The first discharge roller 19 is located, together with a spur roller 41, at the downstream side of the ink-jet head 4 in the transporting direction, and the first discharge roller 19 transports the recording paper 100 on which an image, etc., has been recorded by the ink-jet head 4, in the transporting direction, while pinching the recording paper 100 between the first discharge roller 19 and the spur roller 41.

Figure 5:
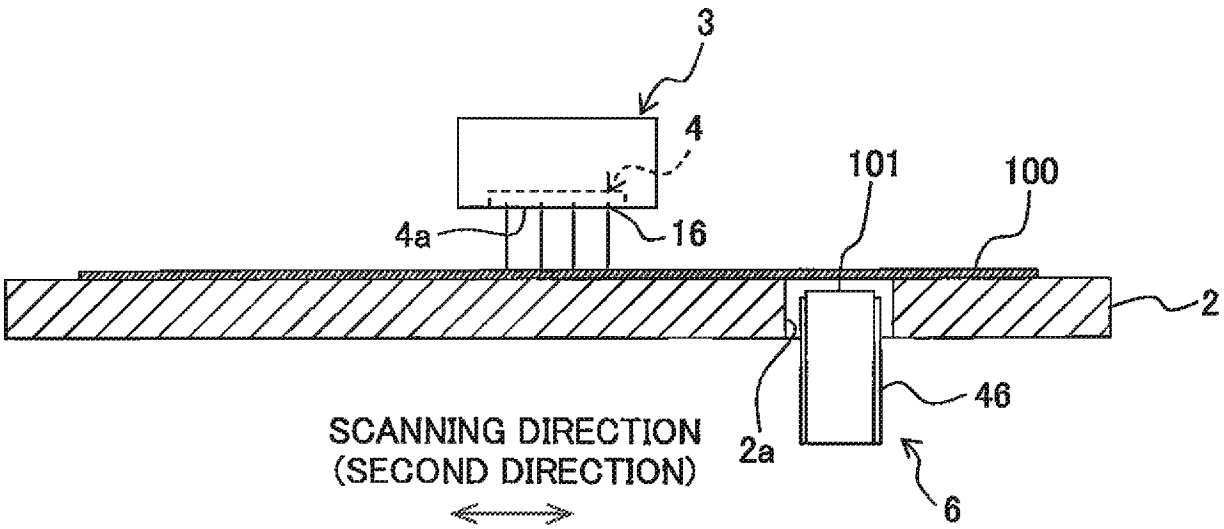
FIG. 5 is a cross-sectional view of the printer shown in FIG. 1 during recording on the recording paper, taken along a V-V line (VII-VII line) in FIG. 1.

The operation of the ink-jet printer 1 when performing recording of image, text, etc. on the recording paper 100 is as follows. As shown in FIG. 5, the ink-jet head 4 causes the ink to be discharged from the nozzles 16, while moving or reciprocating in the scanning direction across the entire area of the recording paper 100 placed on the platen 2. Further, when the ink discharge operation of the ink-jet head 4 is completed, the first transporting mechanism 5 transports the recording paper 100 in the transporting direction by a predetermined transportation amount. By alternately performing the ink discharge operation of the ink-jet head 4 and the transport operation of the first transporting mechanism 5 described above, the image, etc. is/are recorded on the recording paper 100.

Next, the second transporting mechanism 6 will be explained with reference to the drawings. As shown in FIGS. 1 and 4 to 7, the opening 2*a* is formed in the platen 2, and the second transporting mechanism 6 is arranged in the opening 2*a*. Further, as appreciated from FIG. 1, the opening 2*a* is located inside an area, of the platen 2, which is included in an area (facing area) of the platen 2 facing or opposite to the ink-jet head 4 and in which the recording paper 100 is transported. Accordingly, the recording paper 100 on which recording is performed by the ink-jet head 4, is consequently made to pass above or over the opening 2*a*. Further, the opening 2*a* is formed in the facing area of the platen 2 facing the ink-jet head 4 at a position on the upstream side in the transporting direction than a central portion in the transporting direction of the facing area.

The second transporting mechanism 6 has a suction roller (attraction roller) 46, and a second supply roller 44 and a second discharge roller 45 which are arranged to sandwich or interpose the suction roller 46 therebetween in the first direction. The suction roller 46 is arranged to be rotatable inside the opening 2*a*. The suction roller 46 holds, by suction, a portion of the tape 101 having a band shape or strip shape on an upper portion in the outer circumference surface of the suction roller 46. Further, the upper portion in the outer circumference surface of the suction roller 46 holding the tape 101 thereon faces the ink discharge surface 4*a* of the ink-jet head 4. Accordingly, the ink discharged from the nozzles 16 of the ink-jet head 4 are landed on a portion, of the tape 101, sucked and held on the upper portion in the outer circumference surface of the suction roller 46. Note that in the present teaching, the configuration for suction-holding the tape 101 on the suction roller 46 is not limited to any specific configuration, and it is possible to adopt any configuration. For example, it is allowable to adopt such a configuration that the tape 101 is suction-held on the outer circumference surface of the suction roller 46 with a plurality of suction holes formed in the outer circumference surface of the suction roller 46. Further, the configuration for positioning the tape 101 in the opening 2*a* such that the tape 101 faces the nozzles 16 of the ink-jet head 4 is not limited to the suction roller 46, and it is allowable to adopt any configuration. For example, it is allowable to adopt a suction belt 146 (see FIG. 16) which holds the tape 101 by suction on the outer circumference surface of the suction belt with a plurality of suction holes formed in the outer circumference surface of the suction belt 146, in a similar manner with regarding the suction roller 46. Furthermore, the foregoing explanation describes the configurations wherein the tape 101 is suction-held by using the suction force of air on the outer circumference surface of the suction roller 46 and the suction belt 146. However, the present teaching is not limited to such configurations. It is allowable to suction-hold the tape 101 on the outer circumference surface of the suction roller 46 and the suction belt 146 by using the static electricity, magnetic force, friction force, etc., instead of (or in addition to) the suction force by the air.

The second supply roller 44 is located, together with a pressing roller 47, at a position on the upstream side of the suction roller 46 in the transporting direction, and the second supply roller 44 pinches the tape 101 between the second supply roller 44 and the pressing roller 47 and transports the tape 101 toward the suction roller 46. Further, the second discharge roller 45 is located, together with a pressing roller 48, at a position on the downstream side of the suction roller 46 in the transporting direction, and the second discharge roller 45 pinches the tape 101, on which image, text, etc. has/have been recorded, between the second discharge roller 45 and the pressing roller 48 and transports the tape 101 in the transporting direction so that the tape 101 is separate and away from the suction roller 46. When the suction roller 46 located between the two rollers 45 and 46 is rotated counterclockwise in FIG. 6, a portion of the tape 101 sucked and held on the upper portion in the outer circumference surface of the suction roller 46 is transported in the transporting direction.

Figure 7:
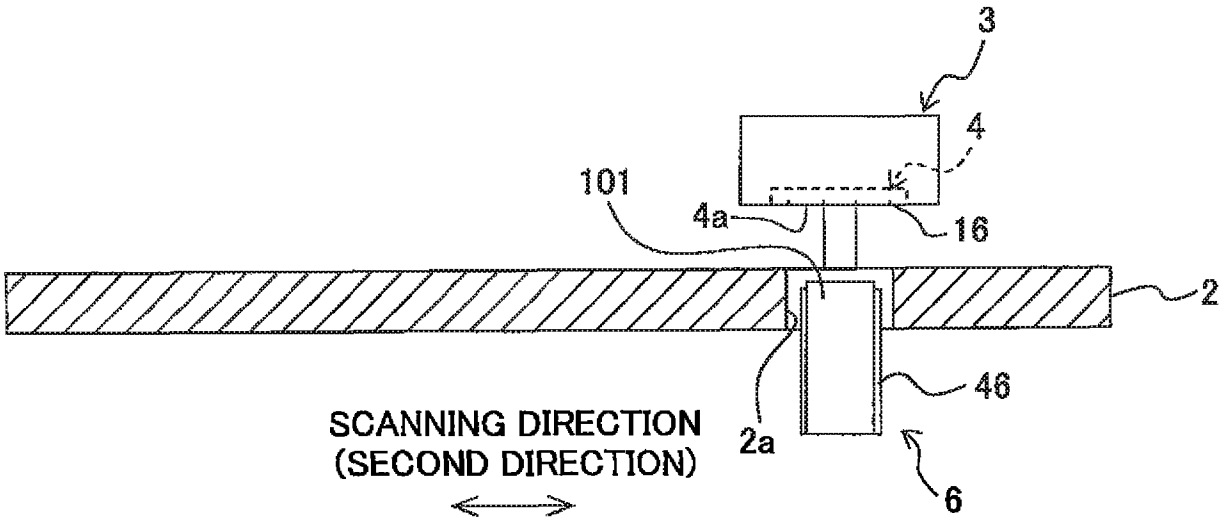
FIG. 7 is a cross-sectional view of the printer shown in FIG. 1 during recording on the tape, taken along a VII-VII line (V-V line) in FIG. 1.

The operation of the ink-jet printer 1 when recording image, text, etc. on the tape 101 is as follows. As shown in FIG. 7, the ink-jet head 4 is moved in the scanning direction, and when then the ink-jet head 4 arrives at the position of the opening 2*a*, the ink-jet head 4 causes the ink to be discharged from the nozzles 16 toward the tape 101 exposed in the opening 2*a*. When the ink discharge operation of the ink-jet head 4 is completed, the tape 101 is transported in the transporting direction at a predetermined transportation amount by the second supply roller 45 and the second discharge roller 46 of the second transporting mechanism 6. By alternately performing the ink discharge operation of the ink-jet head 4 and the transport operation of the second transporting mechanism 6 described above, the image, etc. is/are recorded on the tape 101.

Figure 6:
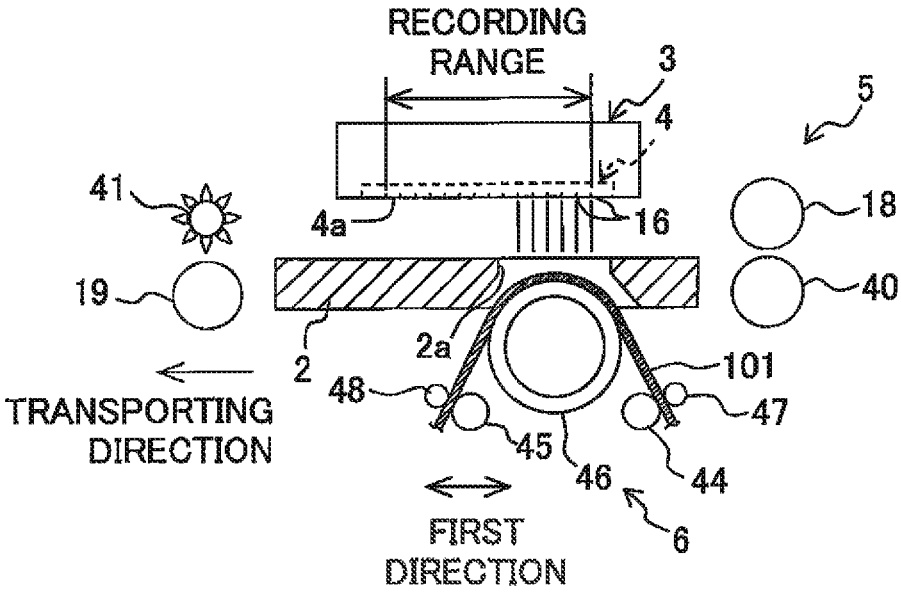
FIG. 6 is a cross-sectional view of the printer shown in FIG. 1 during recording on a tape, taken along the VI-VI line (IV-IV line) in FIG. 1.

Note that as shown in FIGS. 6 and 7, the upper end portion of the suction roller 46 exposed in the opening 2*a* is located at a position below or under the upper end portion of the opening 2*a*, and the tape 101 suction-held by the suction roller 46 is located at a position below or under the upper surface of the platen 2. Namely, the second transporting mechanism 6 transports, in the up and down direction, the tape 101 at a position away from the ink discharge surface 4*a* of the ink-jet head 4 as compared with the recording paper 100. When the position in which the tape 101 is transported is away from the position in which the recording paper 100 is transported as described above, it is possible to transport the recording paper 100 at a position above or over the tape 101 in a state that the tape 101 is remained in a stand-by position at which the tape 101 is suction-held on the suction roller 46 and recording can be performed by the ink-jet head 4 onto the suction-held tape 101 suction-held on the suction roller 46, as shown in FIGS. 4 and 5. Namely, it is possible to perform recording on the recording paper 100 in a state that the tape 101 is remained to be attached to the second transporting mechanism 6.

The tape 101 has a width smaller than that of the recording paper 100, and thus there is a fear that when the spacing distance in the first direction between the two rollers 44 and 45 transporting the tape 101 is great, the posture of the tape 101 while being transported would become unstable. Namely, since the width of the tape 101 at a portion thereof which is pinched between the second supply roller 44 and the pressing roller 47 and between the second discharge roller 45 and the pressing roller 48 is small, the portion of the tape 101 which is positioned between the second supply roller 44 and the second discharge roller 45 is easily twisted, and there is a fear that the tape 101 might be detached or removed from the suction roller 46 in some cases.

In this embodiment, at first, the spacing distance in the first direction between the second supply roller 45 and the second discharge roller 46 which transport the tape 101 is smaller than the spacing distance in the first direction between the first supply roller 18 and the first discharge roller 19 which transport the recording paper 100. Further, as shown in FIG. 6, the second discharge roller 45, among the two rollers 44 and 45 in the second transporting mechanism 6, is located inside the range in which the plurality of nozzles 16 of the ink-jet head 4 are arranged (hereinafter referred to as "recording range"). With these configurations, the spacing distance between the second supply roller 44 and the second discharge roller 45 is made to be further small. Accordingly, it is possible to transport the tape 101, which has a narrow width and which is easily twisted, while making the posture of the tape 101 be stable, thereby making it possible to perform a high-quality printing on the tape 101 by the ink-jet head 4. Further, the portion, of the tape 101, which is exposed in the opening 2*a* to face the ink-jet head 4 is suction-held by the suction roller 46 on the outer circumference surface of the suction roller 46. Since the portion of the tape 101 which is exposed in the opening 2*a* and which is an area (overlap area) overlapping with the recording range of the ink-jet head 4 is held by the suction roller 46 such that the posture thereof is stable, it is possible to perform a high-quality printing by the ink-jet head 4.

Note that the portion, of the tape 101, suction-held by the suction roller 46 sandwiched (intervening) between the second supply roller 44 and the second discharge roller 45 is a portion on which an image, etc, is recorded by the ink-jet head 4. Namely, as shown in FIG. 6, the configuration that the second discharge roller 45 is located inside the recording range of the ink-jet head 4 in the first direction means that nozzles 16, among the plurality of nozzles 16 constructing one nozzle row and located outside of the second supply roller 44 and the second discharge roller 45 (nozzles 16 located on the downstream side of the second discharge roller 45 in the transporting direction, in FIG. 6) are not used to perform recording on the tape 101. Namely, the recording is performed on the tape 101 consequently by using only a part of the nozzles 16 which is arranged between the second supply roller 44 and the second discharge roller 45.

Further, in the embodiment, the opening 2*a* in which the tape 101 and the second transporting mechanism 6 are arranged is formed in the platen 2 at an upstream-side portion of the area (facing area), of the platen 2, facing the ink discharge surface 4*a* of the ink-jet head 4, the upstream-side portion being located on the upstream side in the transporting direction. Therefore, when performing recording on the tape 101, nozzles 16, among the plurality of nozzles 16 constructing one nozzle row in the recording range of the ink-jet head 4 and located on the upstream side in the transporting direction, are used.

As shown in FIG. 2, the plurality of nozzles 16 constructing one of the nozzle rows are communicated with one of the manifolds 25 corresponding to the one nozzle row, and the upstream-side end portion in the transporting direction of this manifold 25 is connected to one of the ink supply holes 26. Here, regarding nozzles 16, among the plurality of nozzles 16, which are communicated with the manifold 25 at a position away from the ink supply hole 26, any discharge abnormality or problem tends to be occur more frequently than regarding other nozzles 16 which are communicated with the manifold 25 at a position close to the ink supply hole 26, for the following reasons. To begin with, air bubbles are easily remained on the side of a forward-end portion of the manifold 25 away from. the ink supply hole 26. In addition to this, when an attempt is made to discharge air bubbles from the respective nozzles with a publicly-known purge method, the pressure is lost until arriving at the forward end portion of the manifold, due to which the ink flow rate is reduced during the purge, thereby making it hard to discharge the air bubbles. In this regard, the embodiment uses nozzles 16, among the plurality of nozzles 16, which are located on the side of the connection end portion of the manifold 25 at which the manifold 25 is connected to the ink supply hole 26, namely uses nozzles 16 in which any discharge abnormality is unlikely to occur.

Further, as shown in FIG. 1, the tape 101 accommodated inside the opening 2*a* is transported within an area, of the platen 2, in the second direction which is included in the facing area of the platen 2 facing the ink-jet head 4 and in which the recording paper 100 is transported. Accordingly, also in a case of performing recording on the tape 101, the ink-jet head 4 can move within the movement range in which the ink jet head 4 moves during performing recording on the recording paper 100. Namely, even when the recording function to perform recording on the tape 101 is added, the size of the ink jet printer 1 in the scanning direction is not increased to be large.

Note that in the embodiment, the arrangement direction of the plurality of nozzles 16 (extending direction of the nozzle rows) is parallel to the transporting direction (first direction) as shown in FIG. 2. However, it is allowable that the arrangement direction of the nozzle rows is inclined with respect to the transporting direction by an angle less than 90 degrees.

Next, modifications to which various kinds of changes are added to the above-described embodiment will be explained. Note that, however, a part or component or configuration which is substantially same as that of the above-described embodiment will be assigned with a same reference numeral as that of the embodiment, and the explanation therefore will be omitted.

[First Modification]

Figure 8:
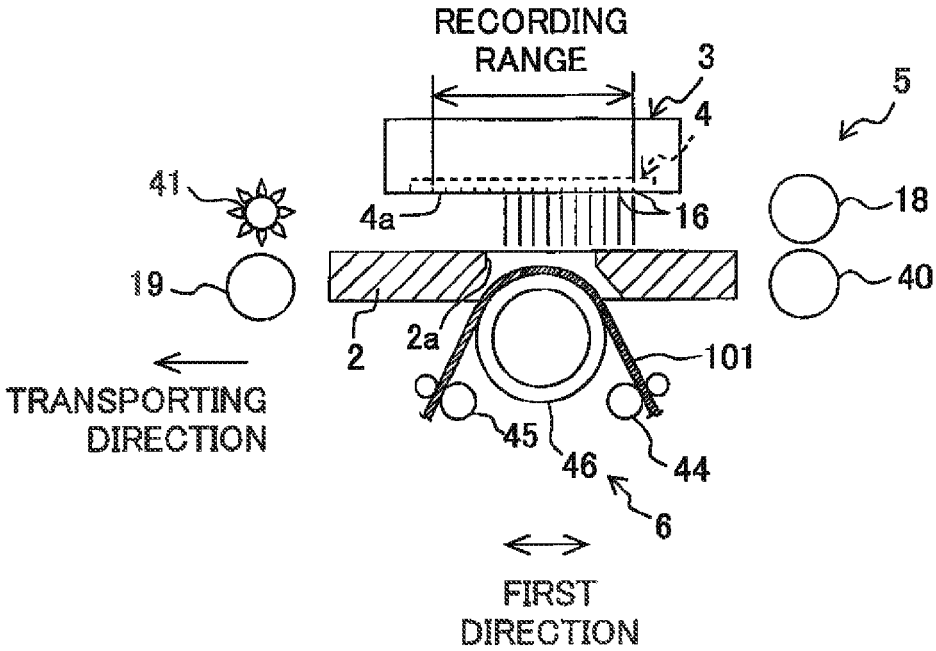
FIG. 8 is a cross-sectional view of a printer of a first modification, corresponding to FIG. 4.

As shown in FIG. 8, both of the second supply roller 44 and the second discharge roller 45 of the second transporting mechanism 6 may be arranged, in the first direction, within the recording range of the ink-jet head 4. In this case, when performing recording on the tape 101, nozzles 16, among the plurality of nozzles 16 within the recording range, which are located between the second supply roller 44 and the second discharge roller 45 are used.

[Second Modification]

Figure 9:
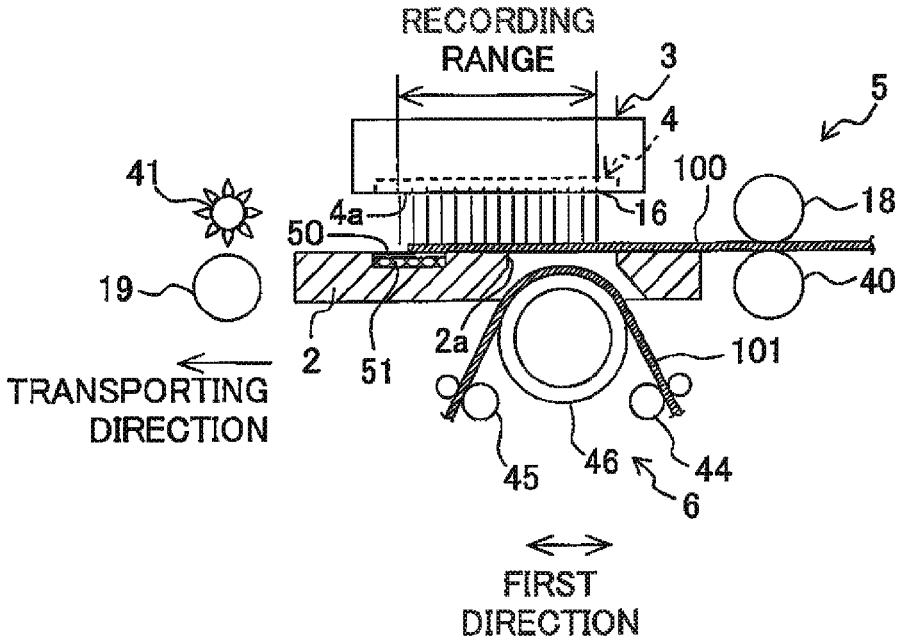
FIG. 9 is a cross-sectional view of a printer of a second modification, corresponding to FIG. 4.

In order to realize a so-called borderless printing for printing image, etc. on the recording paper 100 without providing any space or margin at an edge portion of the recording paper 100 in the ink-jet printer 1, there is required an ink receiving portion which receives an ink, which has been discharged toward the edge portion of the recording paper 100 but is not landed on the recording paper 100. In FIG. 9, an ink receiving portion 50 is provided on the platen 2 within the recording range of the ink-jet head 4 in the first direction, but at a position located different from the position of the opening 2*a* in which the second transporting mechanism 6 is arranged. In other words, in the recording range, the second discharge roller 45 and the ink receiving portion 50 are arranged in the first direction. Further, in the ink receiving portion 50, an absorbing member 51 which absorbs the ink is accommodated. By providing the configuration as shown in FIG. 9, there is provided a printer equipped with the recording function to the tape 101 having a small width and the borderless-recording function to the recording paper 100 having a large width.

[Third Modification]

Figure 10A:
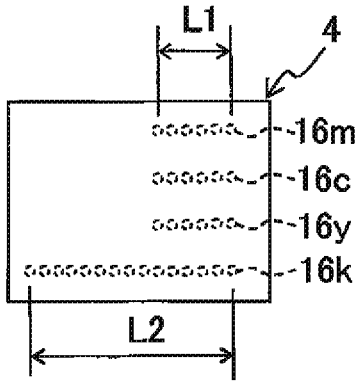

In some cases, the number of the nozzles (length of the arranged nozzles) is different among the four kinds of the nozzles 16 discharging the four different color inks, respectively. For example, in FIG. 10A, three kinds of nozzles 16*y*, 16*c* and 16*m* (first recording elements) which discharge three kinds of yellow, cyan and magenta inks, respectively, are arranged over a first range L1 in the first direction. On the other hand, the number of nozzles 16*k* (second recording elements) which discharges a black ink is greater than the number of each of the nozzles 16*y*, 16*e* and 16*m* (the length of the row of the nozzles 16*k* is greater than that of the rows of the nozzles 16*y*, 16*c* and 16*m*). Namely, the nozzles 16*k* for the black ink are arranged over a second range L2 including the first range L1 and is longer than the first range L1 in the first direction.

Figure 10B:
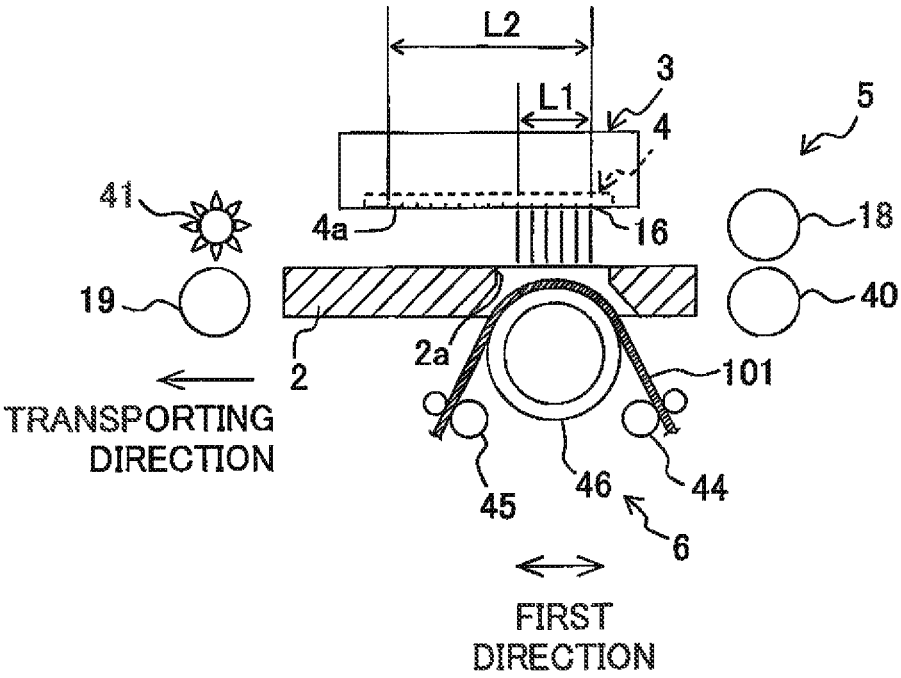

In the ink-jet head 4 having the above-described configuration, when performing four-color printing (recording) on the tape 101 by using all of the four kinds of nozzles 16*k*, 16*y*, 16*c* and 16*m*, it is allowable that the ink-jet head 4 has such a configuration that nozzles 16, among the plurality of nozzles 16, which are located within the first range L1 are used during performing recording on the tape 101. Specifically, as shown, in FIG. 10B, the second supply roller 44 and the second discharge roller 45 are arranged so as to sandwich the nozzles 16 in the first range L1 therebetween (so that the nozzles 16 in the first range L1 are intervened between the second supply roller 44 and the second discharge roller 45). With this, the tape 101 suction-held on the upper portion of the outer circumference surface of the suction roller 46 is consequently located in the first range L1, and the four kinds of nozzles 16*k*, 16*y*, 16*c* and 16*m* arranged in the first range L1 make it possible to perform the four-color printing on the tape 101. Note that in FIG. 10B, although the second supply roller 44 and the second discharge roller 45 are arranged outside of the first range L1, it is allowable that any one of or both of the second supply roller 44 and the second discharge roller 45 is/are arranged inside the first range L1.

[Fourth Modification]

Figure 11:
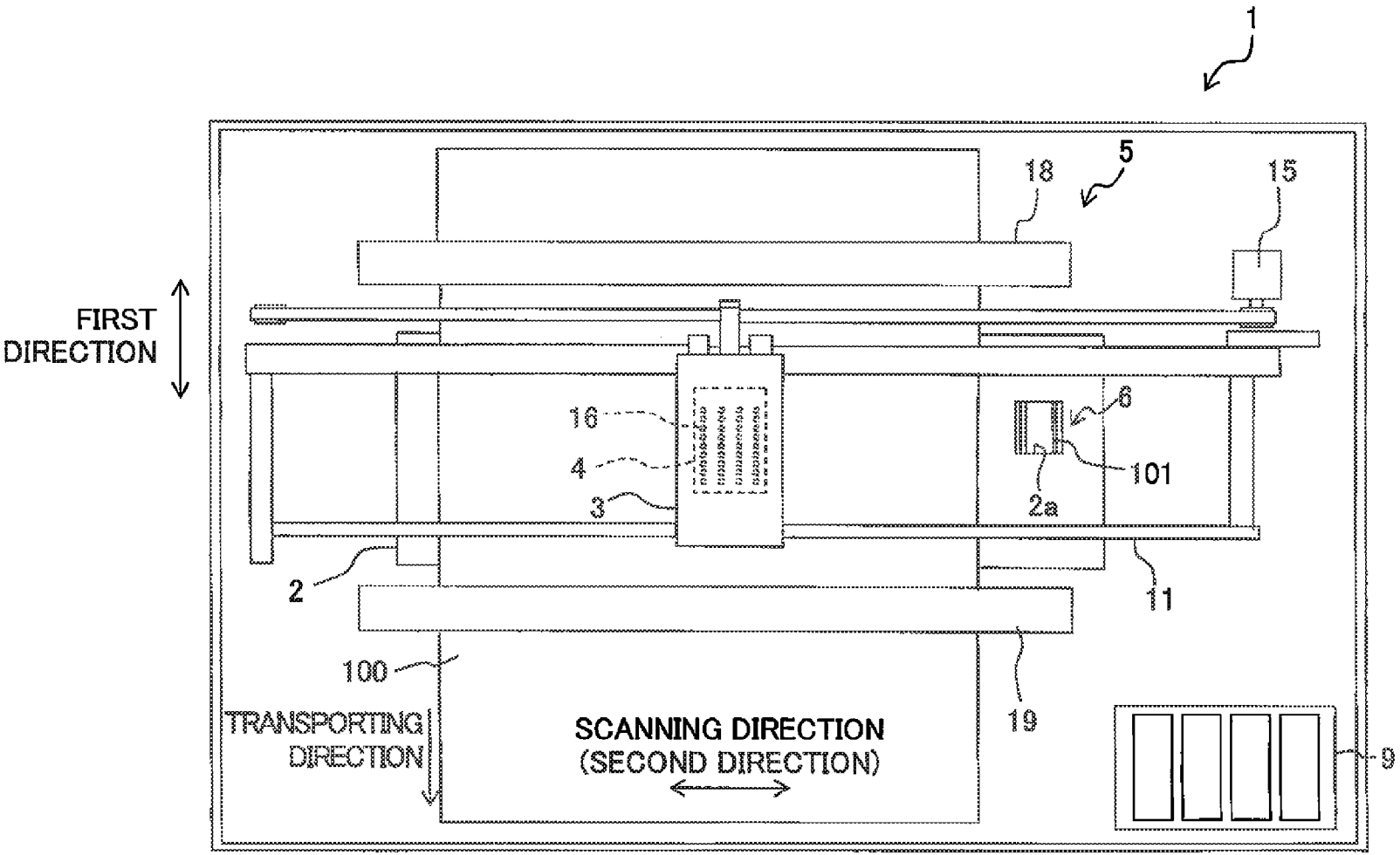
FIG. 11 is a schematic plane view of a printer of a fourth modification.

As shown in FIG. 11, it is allowable that the opening 2*a* of the platen 2 is formed outside in the scanning direction of the range, in which the recording paper 100 is transported; and that the tape 101 is transported to an outside area which is outside of the transportation area for the recording paper 100. Note that, however, in this case, it is necessary to move the ink-jet head 4 further to the area outside in the scanning area when performing recording on the tape 101, as compared with a case of performing recording on the recording paper 100. Accordingly, the size in the scanning direction of the printer 1 is greater than the configuration of the embodiment as shown in FIG. 1, in some cases.

[Fifth Modification]

Figure 12:
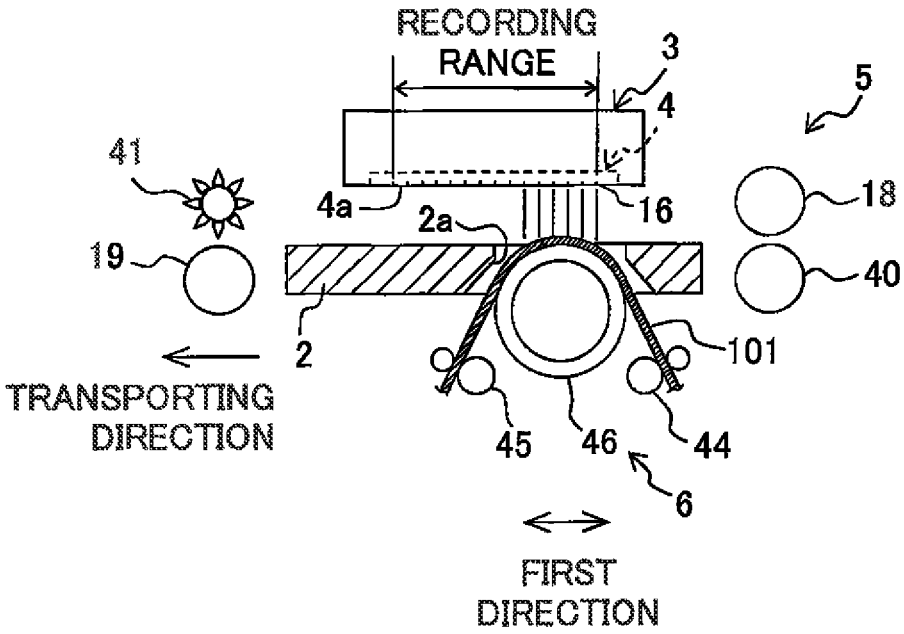
FIG. 12 is a cross-sectional view of a printer of a fifth modification, corresponding to FIG. 4.

It is allowable that the transporting position for the tape 101 transported by the second transporting mechanism 6 is same in the up and down direction as the transporting position for the recording paper 100, or is closer in the up and down direction to the ink-jet head 4 than the transporting position for the recording paper 100. For example, in FIG. 12, the upper end portion of the suction roller 46 is flush with the upper surface of the platen 2, and the tape 101 suction-held by the suction roller 46 is located at a position above or over the upper surface of the platen 2. In this modified aspect, when performing recording on the recording paper 100, it is necessary to remove the tape 101 from the second transporting mechanism 6 in order to avoid interference with the recording paper 100. On the other hand, the distance ranging from the ink-jet head 4 to the tape 101 is made to be smaller as compared with the above-described embodiment, and thus the landing deviation of the ink discharged from the nozzles 16 would be small, which in turn advantageous in view of the recording quality. Note that in a configuration such as the modification shown in FIG. 11 that the tape 101 is transported to the range outside of the transporting range for the recording paper 100, the tape 101 would not interfere with the recording paper 100 even when the tape 101 is set in the second transporting mechanism 6. in such a case, there is no need to remove the tape 101 when performing recording on the recording paper 100.

[Sixth Modification]

In the above-described embodiment, the transporting direction of the recording paper 100 by the first transporting mechanism 5 and the transporting direction of the tape 101 by the second transporting mechanism 6 are same in the facing area facing the ink-jet head 4, as shown in FIGS. 5 and 6. However, the transporting direction of the recording paper 100 by the first transporting mechanism 5 and the transporting direction of the tape 101 by the second transporting mechanism 6 may be opposite to each other. For example, in a case of transporting the recording paper 100 by the first transporting mechanism 5 in the rightward direction in FIG. 1 (as indicated by arrow of "transporting direction"), it is allowable to provide such a configuration that the tape 101 is transported by the second transporting mechanism 6 in the leftward direction in FIG. 1 (opposite to the direction indicated by arrow of "transporting direction).

[Seventh Modification]

The second recording medium having the size smaller than that of the recording paper 100 is not limited to a continuous band-shaped or strip-shaped medium as the tape 101 of the embodiment. For example, the second recording medium may be a small-sized rectangular paper sheet such as a business-card sized paper or repositionable note (tag-label, slip-note or paper-tape) having width and length smaller than those of the recording paper 100, In particular, in a case that the length in the first direction (transporting direction) of the second recording medium is shorter than the spacing distance in the first direction between the first supply roller 18 and the first discharge roller 19 of the first transporting mechanism 5, to begin with, it is not possible to transport such a second recording medium by the first transporting mechanism 5. For this reason, it is desirable to adopt the present teaching to thereby provide the second transporting mechanism 6 dedicated to transport the second recording medium, and to make the spacing distance between the two rollers of the second transporting mechanism 6 be as small as possible.

[Eighth Modification]

Figure 13:
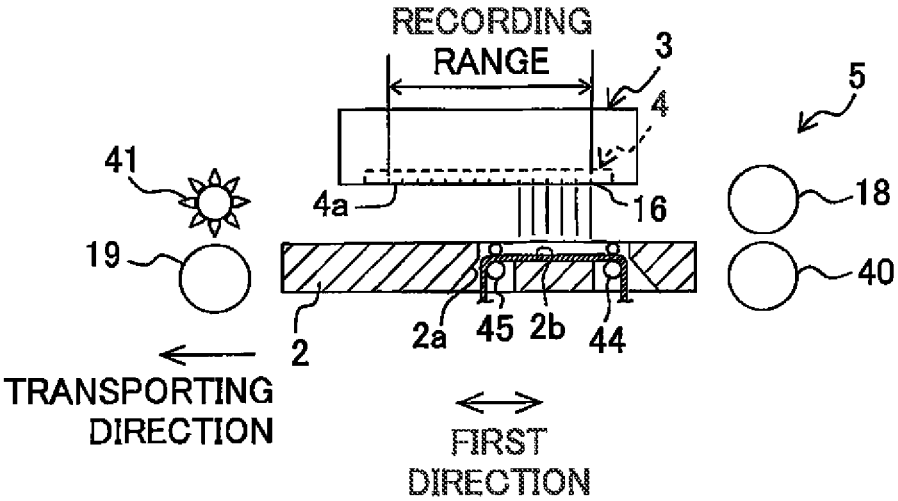
FIG. 13 is a cross-sectional view of a printer of an eighth modification, corresponding to FIG. 4.

The second transporting mechanism 6 which transports the second recording medium can be changed or modified in accordance with the size and/or shape of the second recording medium to be transported by the second transporting mechanism 6. For example, as shown in FIG. 13, it is allowable that the second transporting mechanism 6 has a placement surface 2*b* which is parallel to the upper surface of the platen 2, instead of having the suction roller 46 of the embodiment; and that the second supply roller 44 and the second discharge roller 45 are arranged to sandwich the placement surface 2*b* in the first direction.

[Ninth Modification]

Figure 14:
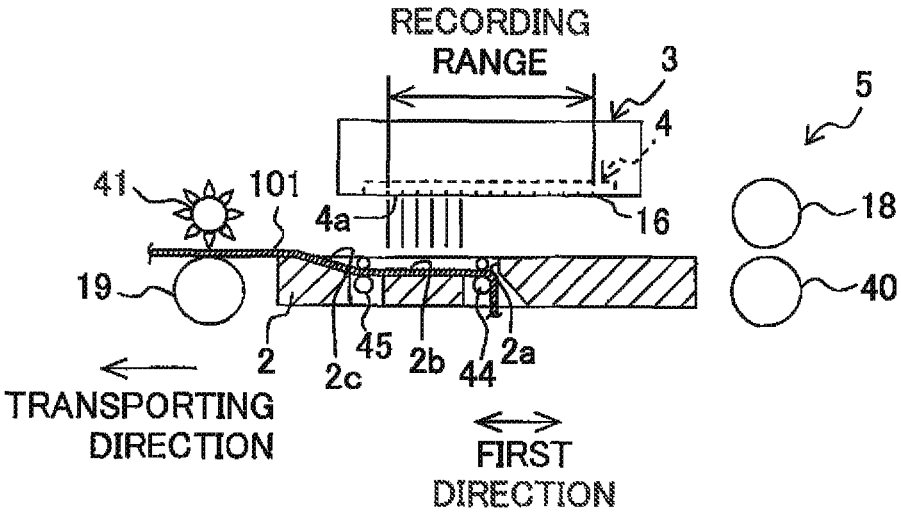
FIG. 14 is a cross-sectional view of a printer of a ninth modification, corresponding to FIG. 4.

The second recording medium on which the recording has been performed by the inkjet head 4 may be discharged by the first discharge roller 19 of the first transporting mechanism 5. For example, as shown in FIG. 14, the upper surface of a portion, of the platen 2, located between the second supply roller 45 and the first discharge roller 19 is made to be a guiding surface 2*c* which is inclined upward toward the downstream side in the transporting direction. The guiding surface 2*c* guides the tape 101 from, the second discharge roller 45 to the first discharge roller 19. Note that in FIG. 14, the second discharge roller 45 is located on the downstream of the recording range in the transporting direction so as to arrange the second discharge roller 45 as close as possible to the first discharge roller 19; and conversely that the second supply roller 44 is located inside the recording range. In this configuration, the tape 101 on which the recording has been performed by the inkjet head 4 is transported or fed to the first discharge roller 19 while being guided from the second discharge roller 45 by the guiding surface 2*c*. Namely, since the recording paper 100 and the tape 101 are discharged by the same first discharge roller 19, the discharge route is made to be common for the recording paper 100 and the tape 101.

[Tenth Modification]

Figure 15:
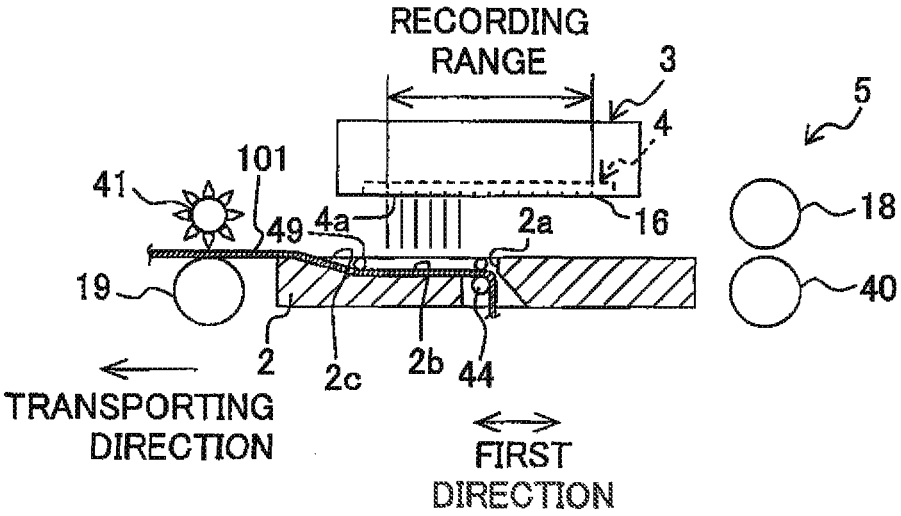
FIG. 15 is a cross-sectional view of a printer of a tenth modification, corresponding to FIG. 4.

It is also allowable to further omit the second discharge roller 45 in the ninth modification as described above with reference to FIG. 14. Namely, as shown in FIG. 15, the tape 101 is transported from the second supply roller 44, which is arranged within the recording range, toward a placement surface 2*b* of the platen 2 facing the ink-jet head 4. The tape 101 on which the recording has been performed by the ink-jet head 4 is guided to the first discharge roller 19 by a guiding surface 2*c* continued to the placement surface 2, Note that a roller 49 in FIG. 15 is a pressing roller for preventing the tape 101 from floating of being lifted up.

[Eleventh Modification]

Figure 16:
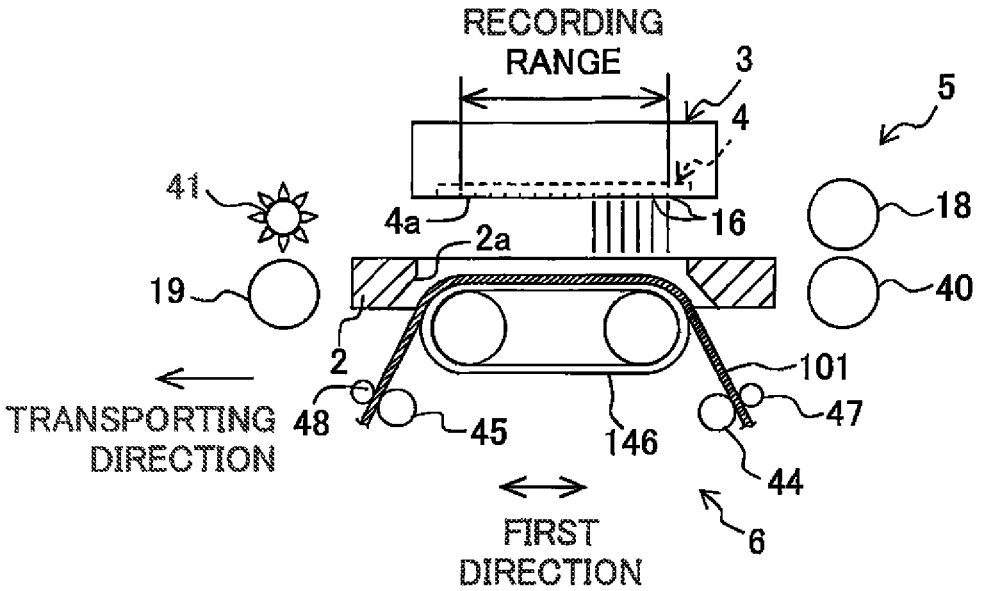
FIG. 16 is a schematic plane view of a printer of an eleventh modification.

In the above-described embodiment and the modifications, at least one of the second supply roller 44 and the second discharge roller 45 is arranged in the first direction within the range in which the plurality of nozzles 16 of the ink-jet head 4 are arranged (namely, within the recording range). However, provided that the second transporting mechanism 6 is provided with a configuration such as a transporting roller capable of transporting the second recording medium such as the tape 101, etc., in the transporting direction while supporting the second recording medium so that the position of the second recording medium is not deviated (shifted, displaced) during the transportation within the recording range of the ink-jet head 4, it is not necessarily indispensable that at least one of the second supply roller 44 and the second discharge roller 45 is arranged in the first direction within the recording range in which the plurality of nozzles 16 of the ink-jet head 4 are arranged. For example, as shown in FIG. 16, in a case that the second transporting mechanism 6 is provided with a suction belt 146 which holds, by suction, the tape 101 on the outer circumference surface of the suction belt 146 with a plurality of attraction holes formed in the outer circumference surface of the suction belt 146, it is allowable that both of the second supply roller 44 and the second discharge roller 45 are arranged in the first direction at the outside of the recording range in which the plurality of nozzles 16 of the ink-jet head 4 are arranged. In this case, the tape 101 is transported to the overlap area overlapping with the recording range of the ink-jet head 4 in a state that the tape 101 is suction-held on the outer circumference surface of the suction belt 146 so that the position of the tape 101 is not shifted or deviated within the recording range; and thus it is possible to hold the tape 101 so that the posture of the tape 101 is made stable by the suction belt 146, thereby making it possible to realize a high-quality recording by the ink-jet head 4.

[Twelfth Modification]

Figure 17:
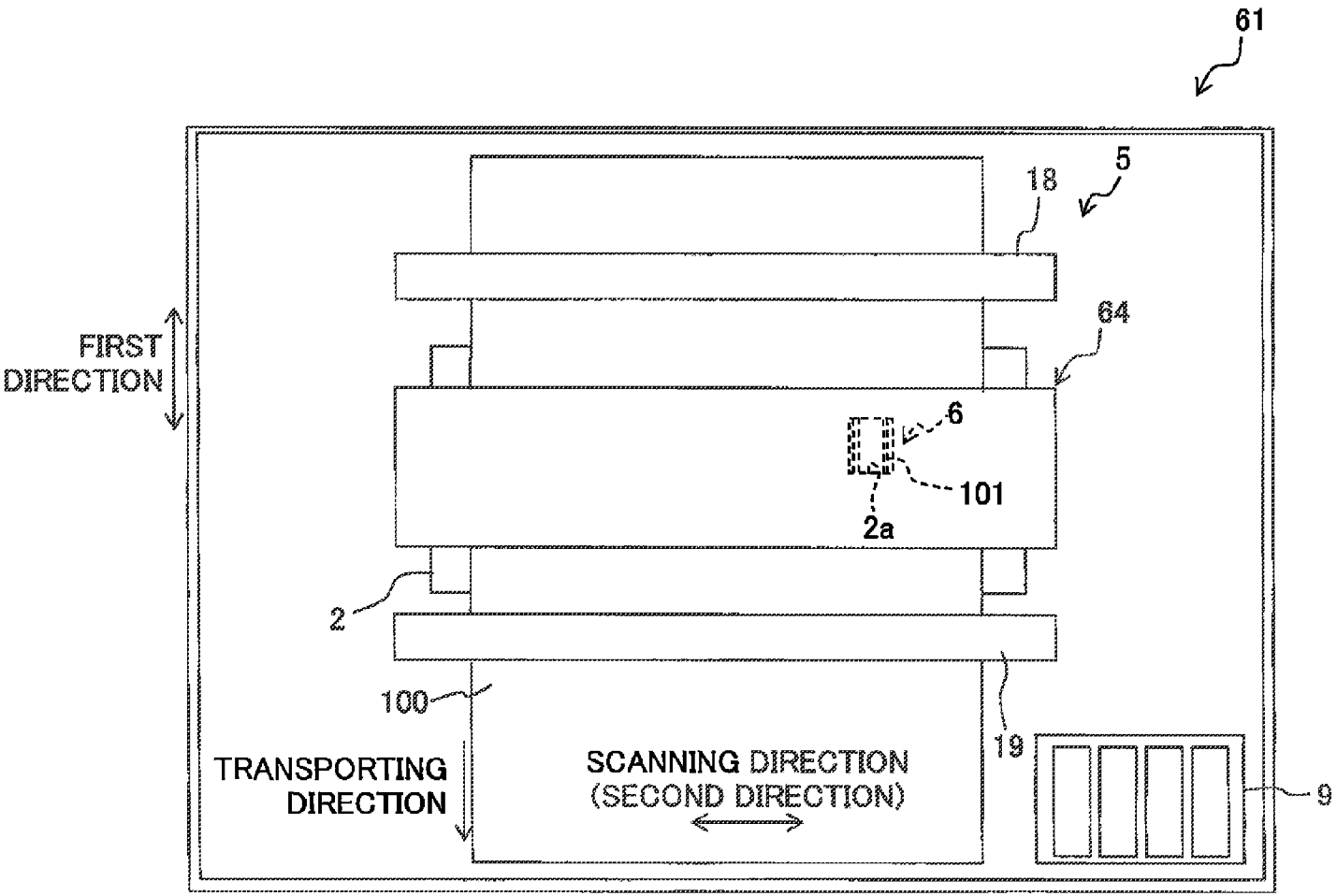
FIG. 17 is a schematic plane view of a printer of an twelfth modification.

In the embodiment, the ink-jet head 4 is a so-called serial-type head which discharges the ink onto the recording medium (recording paper 100 and the tape 101) while moving in the scanning direction (second direction). However, an object to which the present teaching is applicable is not limited to such a serial-type head. Namely, as shown in FIG. 17, an ink-jet head 64 of a printer 61 may be a so-called line-type head which discharges ink in a fixed state. Specifically, the ink-jet head 64 has a plurality of nozzle rows which extend to be parallel to each other in the second direction and which are arranged in the first direction. In a case of performing recording on the tape 101 as the second recording medium, only a nozzle row, among the plurality of nozzle rows, which is located between the second supply roller 44 and the second discharge roller 45, is used.

In the foregoing, the present teaching has been explained by way of example of an embodiment that the present teaching is applied to an ink-jet printer provided with an ink-jet head as the recording head. In the above explanation, the present teaching is applied to the ink-jet printer in which the ink is discharged by using the pressure generated when the pressure chamber is deformed by the piezoelectric actuator. However, the present teaching is also applicable to an ink-jet printer in which the ink is discharged by using the pressure generated when the ink is heated. Further, the present teaching is also applicable to a recording apparatus other than the ink-jet printer. For example, it is also possible to apply the present teaching to a thermal printer having a thermal head, as the recording head, in which a plurality of heater elements (corresponding to the recording elements of the present teaching) are arranged in the first direction.

What is claimed is:

1. A recording apparatus configured to perform recording on a first recording medium and on a second recording medium, the recording apparatus comprising:

a recording head having a plurality of recording elements arranged in a first direction;

a first transporting mechanism including a first supply roller and a first discharge roller which are arranged to sandwich the recording head therebetween in the first direction, and configured to transport the first recording medium with respect to the recording head in the first direction by the first supply roller and the first discharge roller; and a second transporting mechanism arranged between the first supply roller and the first discharge roller in the first direction, configured to transport the second recording medium in the first direction while maintaining posture of the second recording medium, and configured to hold an overlap portion, of the second recording medium, overlapping in the first direction with a portion of a recording range in which the plurality of recording elements of the recording head are arranged; and a controller configured to control the recording head to perform recording on the second recording medium, which is transported by the second transporting mechanism, by using only a part of the recording elements arranged in the first direction, the part of the recording elements being located to overlap with the overlap area, of the second recording medium, held by the second transporting mechanism.

2. The recording apparatus according to claim 1, wherein the second transporting mechanism includes a second supply roller and a second discharge roller which are arranged with a spacing distance therebetween in the first direction, the second transporting mechanism being configured to transport the second recording medium by the second supply roller and the second discharge roller with respect to the recording head in the first direction; and the spacing distance between the second supply roller and the second discharge roller in the first direction is smaller than a spacing distance between the first supply roller and the first discharge roller in the first direction.

3. The recording apparatus according to claim 2, wherein the recording head includes a plurality of first recording elements which are arranged over a first range in the first direction, and a plurality of second recording elements which are arranged over a second range in the first direction, the second range including the first range and being longer than the first range in the first direction;

the second supply roller and the second discharge roller are arranged in the first direction to sandwich at least a part of the plurality of first and second recording elements therebetween in the first direction, the part of the plurality of first and second recording elements being located within in the first range; and the controller is configured to control the recording head to perform recording on the second recording medium, which is transported by the second transporting mechanism, by using first and second recording elements, among the plurality of first recording elements and the plurality of second recording elements, which are arranged in the first range and which are sandwiched between the second supply roller and the second discharge roller in the first direction.

4. The recording apparatus according to claim 2, further comprising a guiding mechanism configured to guide the second recording medium from the second discharge roller to the first discharge roller of the first transporting mechanism;

wherein a transporting direction of the first recording medium by the first transporting mechanism is same as a transporting direction of the second recording medium by the second transporting mechanism; and the second recording medium, on which the recording has been performed by the recording head, is guided from the second discharge roller by the guiding mechanism and is transported to the first discharge roller.

5. The recording apparatus according to claim 2, further comprising a head moving mechanism configured to move the recording head in a second direction crossing the first direction;

wherein the controller is configured to control the head moving mechanism and the recording head to perform recording on the first recording medium or the second recording medium while moving the recording head in the second direction;

a width of the second recording medium in the second direction is smaller than a width of the first recording medium in the second direction; and the second transporting mechanism is configured to transport the second recording medium to an area which is included in a facing area facing the recording head moving in the second direction, and to which the first recording medium is transported.

6. The recording apparatus according to claim 2, wherein in a direction orthogonal to a plane including the first direction, the second transporting mechanism is configured to transport the second recording medium in the first direction at a position away from the recording head than the first recording medium.

7. The recording apparatus according to claim 2, wherein the recording head includes a plurality of nozzle configured to discharge an ink, as the plurality of recording elements; and at least one of the second supply roller and the second discharge roller of the second transporting mechanism and an ink receiving portion are arranged in the first direction within the recording range in the first direction of the recording head, the ink receiving portion being configured to receive an ink, included in the ink discharged toward an edge portion in the first direction of the first recording medium but not landed on the first recording medium.

8. The recording apparatus according to claim 2, wherein the recording head includes:

a plurality of nozzles as the plurality of recording elements which are arranged in the first direction and which are each configured to discharge an ink;

a common ink chamber which extends in the first direction and which is commonly communicated with the plurality of nozzles; and an ink supply section which is communicated with an end portion in the first direction of the common ink chamber;

wherein a part of the plurality of nozzles arranged in the first direction is located closer to a side of the end portion than other nozzles among the plurality of nozzles and different from the part of the plurality of nozzles, the part of the nozzles being arranged between the second supply roller and the second discharge roller.

9. The recording apparatus according to claim 2, wherein the second transporting mechanism is configured to transport the second recording medium having a length of in the first direction which is shorter than the spacing distance between the first supply roller and the first discharge roller in the first direction.

10. The recording apparatus according to claim 2, wherein the second transporting mechanism is configured to transport the second recording medium having a width in a direction orthogonal to the first direction which is smaller than that of the first recording medium.

11. The recording apparatus according to claim 1, wherein the second transporting mechanism includes a guide mechanism configured to guide the second recording medium, on which the recording has been performed by the recording head, to the first discharge roller of the first transporting mechanism, in a same direction same as the first direction in which the first recording medium is transported by the first transporting mechanism;

the second supply roller is located, in the first direction, inside the recording range in the first direction in which the plurality of recording elements of the recording head are arranged; and the controller is configured to control the recording head to perform the recording on the second recording medium, which is transported by the second transporting mechanism, by using only a part of the recording elements arranged in the first direction, the part of the recording elements being located between the second supply roller and the first discharge roller.

12. The recording apparatus according to claim 1, wherein the first transporting mechanism has a platen on which the first recording medium is placed; and the platen has an opening which is formed therein and via which the overlap area of the second recording medium, held by the second transporting mechanism, is exposed with respect to the recording head.

13. The recording apparatus according to claim 12, further comprising a head moving mechanism configured to move the recording head in a second direction crossing the first direction;

wherein the opening is located at a position not overlapping with the first recording medium in the second direction.

14. The recording apparatus according to claim 12, wherein the second transporting mechanism is configured to hold the overlap area of the second recording medium at a position away from the recording head as compared with a placement surface, of the platen, on which the first recording medium is placed.

15. The recording apparatus according to claim 1, wherein the second transporting mechanism includes a suction roller or a suction belt configured to hold, on an outer circumference surface thereof, the second recording medium by suction.

16. The recording apparatus according to claim 1, wherein the first and second transporting mechanisms are configured to transport the first and second recording media, respectively, at a same time.

* * * * *